US005909605A

United States Patent [19]

Nishizawa et al.

[11] Patent Number: 5,909,605

[45] Date of Patent: Jun. 1, 1999

[54] IMAGE RECORDING DEVICE WITH TRANSFER CONTROL

[75] Inventors: Akinori Nishizawa, Uji; Naohiro Okada, Kyoto, both of Japan

[73] Assignee: Murata Kikai Kabushiki Kaisha, Kyoto, Japan

[21] Appl. No.: 08/996,131

[22] Filed: Dec. 22, 1997

[30] Foreign Application Priority Data

Dec. 27, 1996 [JP] Japan ..... 8-350623

[51] Int. Cl.[6] ..... G03G 15/16

[52] U.S. Cl. ..... 399/66

[58] Field of Search ..... 399/66, 44, 313, 399/314

[56] References Cited

U.S. PATENT DOCUMENTS

| | | | |
|---|---|---|---|
| 3,837,741 | 9/1974 | Spencer | 399/44 |
| 4,338,017 | 7/1982 | Nishikawa | 399/145 |
| 4,977,430 | 12/1990 | Florack et al. | 399/314 |
| 5,119,141 | 6/1992 | Bhagat | 399/44 |
| 5,182,598 | 1/1993 | Hara et al. | 399/303 |
| 5,761,568 | 6/1998 | Haragakiuchi et al. | 399/44 |

FOREIGN PATENT DOCUMENTS

| | | |
|---|---|---|
| 8-115000 | 5/1996 | Japan . |
| 8-240958 | 9/1996 | Japan . |

*Primary Examiner*—Robert Beatty
*Attorney, Agent, or Firm*—Armstrong, Westerman, Hattori, McLeland & Naughton

[57] ABSTRACT

The image recording device includes a paper feed device for feeding a recording paper, a photosensitive body, a toner feeding unit, a module for forming a toner image on the photosensitive body, and a transferring roller. The photosensitive body is opposed to the transferring roller such that the recording paper fed from the paper feed unit is nipped between the photosensitive body and the transferring roller. The image recording device also includes a voltage generator for generating a voltage to be applied to the transferring roller. The voltage to be generated by the voltage generator is adjusted such that transfer of the toner image onto the paper is properly carried out. The collective resistance of the transfer roller and photosensitive body is detected and the voltage generated by the voltage generator is adjusted accordingly.

17 Claims, 6 Drawing Sheets

IMAGE RECORDING DEVICE WITH TRANSFER CONTROL

BACKGROUND OF THE INVENTION

1. Technical Field

The present invention relates to an image recording device of an electrophotographic type for transferring a toner image on a photosensitive body onto paper by means of a transferring roller to which a voltage is applied.

2. Background Art

Generally, an image recording device of an electrophotographic type is provided with a charger for uniformly charging the surface of a photosensitive drum, an exposer for forming an electrostatic latent Image by irradiating light on the surface of the photosensitive drum, a developer for forming a toner image by adhering toner to the electrostatic latent image and a transfer unit for transferring the toner image onto paper. A conventional transfer unit is provided with a discharge wire for carrying out corona discharge. In transferring the toner image, a predetermined high voltage is applied to the transferring roller which is located on the opposite side of the photosensitive drum over the paper by corona discharge from the transfer unit. Further, the toner image on the photosensitive drum is attracted toward the paper based on a potential difference between the voltage of the photosensitive drum and the voltage of the transfer unit and is transferred onto the paper.

Corona discharge is accompanied by generation of ozone, and in recent years, in view of environmental concerns, an image recording device that does not generate ozone, more specifically, a technology for transferring a toner image without using corona discharge has been requested. To meet the request, a transfer unit is designed to have a roller made from urethane foam or the like and a predetermined high voltage is applied to the transferring roller so that a potential difference is produced between a photosensitive drum and a transferring roller which are arranged to nip the paper.

However, the transferring roller constructed of urethane foam or the like has a resistance value which changes in accordance with changes in the surrounding environmental conditions such as temperature, humidity or the like. Therefore, even if a voltage predetermined under a particular condition as an optimum voltage (optimum voltage for transferring a toner image) is applied to the transferring roller in order to set the voltage of the transferring roller to the predetermined voltage, the environmental conditions of the transferring roller may have already changed when the voltage is actually applied to the transferring roller. Since the optimum voltage varies with the environmental conditions, always applying the same predetermined voltage to the transferring roller would result in insufficient adhesion of the toner image to the paper and deterioration of the quality of the transferred image.

Another conventional image recording device is disclosed in Japanese Patent Application, Laid-Open Publication No. 8-123222. This image recording device adjusts the application voltage depending upon various conditions, but the resistance of the transferring roller and environmental temperature are not among these conditions.

Still another conventional image recording device is disclosed in Japanese Patent Application, Laid-Open Publication No. 4-275583. This image recording device determines a voltage Vt' to be applied to a transfer member by the equation of $Vt'=aVt+b$ where Vt is the voltage of the transfer member when no image transfer operation is conducted, and "a" and "b" are compensation coefficients. The voltage Vt is compared with a reference value and the coefficients "a" and "b" are changed based on a difference between the voltage Vt and the reference value such that the application voltage Vt' is adjusted according to changing conditions.

SUMMARY OF THE INVENTION

It is an object of the present invention to provide an image recording device capable of setting the voltage of a transferring roller to a proper voltage so that the images are properly transferred, and capable of always providing a high quality transferred image.

In order to achieve the above-described object, according to a first aspect of the present invention, there is provided an image recording device comprising a paper feed mechanism, a photosensitive body, means for forming a toner image on the photosensitive body, a transferring roller arranged mutually opposed to the photosensitive body such that paper from the paper feed mechanism is brought into close contact with the photosensitive body by the transferring roller (or nipped between the transferring roller and the photosensitive body), a voltage generator for feeding a voltage to the transferring roller to cause the toner image on the photosensitive body to be transferred onto the paper, and adjusting means for adjusting the voltage to be generated by the voltage generator such that the toner image is properly transferred to the paper.

According to the image recording device of the present invention, the voltage applied to the transferring roller is adjusted such that the transfer of the toner image is carried out properly; in other words, the voltage of the transferring roller is set to the optimum voltage for transferring the toner image. Therefore, the toner image can always be transferred under appropriate conditions and forms a uniform, high-quality image on the paper.

The adjusting means may include a first detecting means for detecting an inner condition prior to the transfer of the toner image, a second detecting means for detecting an outer condition prior to the transfer of the toner image and a determining means for determining the voltage to be applied on the transferring roller based on detection results of the first and second detecting means.

The first detecting means may detect at least a resistance value of the transferring roller as the inner condition and the second detecting means may detect an environmental temperature as the outer condition.

The adjusting means may include a correcting means having a characteristic reverse to an environmental characteristic of a resistance value of a process unit. The process unit is a unit for forming the image and includes at least a photosensitive body and a transferring roller. A synthesized resistance value of the process unit and the correcting means can be made constant regardless of the environment since the correcting means has a temperature-resistance characteristic reverse to that of the resistance of the process unit. Accordingly, the transferring voltage can always be set to an optimum voltage. In other words, the synthesized resistance value can be made constant regardless of changing environmental temperature. The correcting means may be a variable resistor.

BRIEF DESCRIPTION OF THE ACCOMPANYING DRAWINGS

DETAILED DESCRIPTION OF THE PREFERRED EMBODIMENTS

Now, preferred embodiments of the present invention will be described with reference to the accompanying drawings.

First Embodiment

A description will be given of a first embodiment of the present invention in reference to FIG. 1 through FIG. 5.

Figure 1:
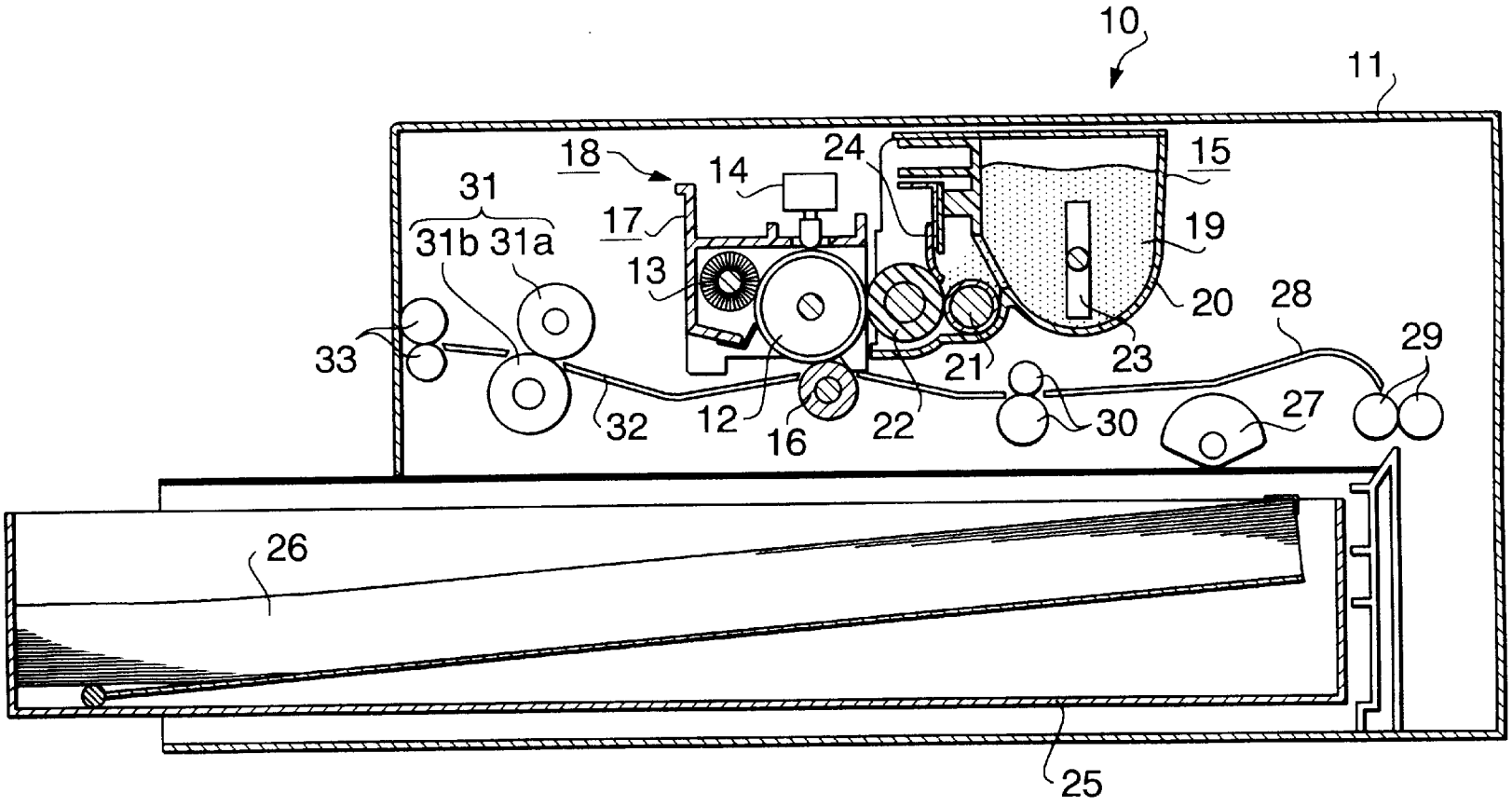
FIG. 1 is a longitudinal sectional view showing an outline of an image recording device according to a first embodiment of the present invention.

Referring to FIG. 1, illustrated is an image recording device 10 according to the present invention. A photosensitive drum 12 that is a photosensitive body having a photo conductive film on its outer peripheral face is arranged inside of a device case 11. The photosensitive drum 12 is grounded. A charger 13, an exposer 14, a developer unit 15 and a transferring roller 16 are successively arranged in this order around the photosensitive drum 12 along the rotational path (in the direction as indicated by the arrow mark A in FIG. 2) of the photosensitive drum 12. The photosensitive drum 12 and the charger 13 are united as a drum unit 17. The photosensitive drum 12 is rotated by a drive, not illustrated, that is provided outside of the drum unit 17. Although not illustrated, the upper portion of the device case 11 is constituted to be capable of pivoting to open or close, and the drum unit 17 and the developer unit 15 can be individually removed from the inside of the device case 11 when the upper portion of the device case 11 is opened. The drum unit 17, the exposer 14, the developer unit 15 and the transferring roller 16 constitute a process unit 18 for forming an image and transferring the image onto paper.

The charger 13 is a charger of a brush-roller type constituted by implanting a number of conductive bristles on the outer periphery of a shaft. A predetermined bias voltage is applied to the charger 13. The charger 13 applied with the bias voltage uniformly charges the outer peripheral face of the photosensitive drum 12 at approximately −750V.

The exposer 14 has a number of LEDs (Light Emitting Diode) and irradiates light on the outer peripheral face of the photosensitive drum 12 based on inputted image information. With the irradiation of light on the outer peripheral face of the photosensitive drum 12, the potential of the portion irradiated with light (the portion corresponding to black of the image information) becomes approximately −50V and causes a potential difference between the portion irradiated with light and the portion not irradiated with light (the portion corresponding to white of the image information). As a result, an electrostatic latent image corresponding to the image information is formed on the outer peripheral face of the photosensitive drum 12.

The developer unit 15 is provided with a toner case 20 for storing toner 19, a supply roller 21 arranged in the lower portion in the case 20 and a developing roller 22 arranged at the lower open end of the toner case 20, placed between the supply roller 21 and the photosensitive drum 12. The supply roller 21 and the developing roller 22 are rotated in directions shown by arrow mark B and arrow mark C, respectively, in FIG. 2 by a drive, not illustrated, provided outside of the developer unit 15.

The supply roller 21 is constituted by a shaft 21*a* made of a metal (for example, stainless steel) and a conductive foamed body (for example, urethane foam) 21*b* attached at the surrounding of the shaft 21*a*. A predetermined bias voltage (−600 through −700V, preferably, about −650V) is applied to the supply roller 21. The developing roller 22 is constituted by a shaft 22*a* made of a metal (for example, stainless steel) and conductive rubber 22*b* attached to the surrounding of the shaft 22*a*. Butadiene acrylonitrile rubber (NBR), silicone rubber or urethane rubber are preferably used as the conductive rubber 22*b*. The developing roller 22 is brought into contact with the outer peripheral faces of the supply roller 21 and the photosensitive drum 12. A predetermined bias voltage (−300 through −400V, preferably, −350V) is applied to the developing roller 22.

A stirrer 23 is arranged in the toner case 20 so that it can be rotated by a drive source, not illustrated, and stirs the toner 19 in the case 20. A regulating blade 24 is attached to the lower open end of the toner case 20 to be brought into elastic or resilient contact with the outer peripheral face of the developing roller 22. The blade 24 is provided to make the toner attached to the outer peripheral face of the developing roller 22 a layer of uniform thickness. The blade 24 comprises an elastic material made of conductive rubber or metal, preferably urethane rubber sheet or stainless steel sheet. A predetermined bias voltage (−600 through −700V, preferably, about −650V) is applied to the blade 24.

With the respective rotations of the supply roller 21 and the developing roller 22, the rollers rub each other, and further, bias voltages are applied to the respective rollers 21 and 22 by which the toner 19 present in the vicinity of the both rollers 21 and 22 is charged. Upon rotation of the supply roller 21, the toner filled in gas cavities in the foamed body 21*b* of the roller 21 is transferred to the developing roller 22. The toner is moved from the supply roller 21 to the developing roller 22 and is adhered to the outer peripheral face of the developing roller 22 at portions of the supply roller 21 and the developing roller 22 where they are brought into contact with each other, based on the potential difference between the two rollers 21 and 22. The toner adhered to the outer peripheral face of the developing roller 22 is transferred to the photosensitive drum 12 via the regulating blade 24 in accordance with the rotation of the developing roller 22. The thickness of the layer of toner on the developing roller 22 is made uniform by the regulating blade 24 in passing through the regulating blade 24.

The toner on the developing roller 22 is charged at about −650V. Therefore, when the toner on the developing roller 22 is brought into contact with the photosensitive drum 12, the toner is attracted to the electrostatic latent image based on the potential difference between the toner and the electrostatic latent image on the photosensitive drum 12, whereby a toner image is formed on the photosensitive drum 12.

A paper feed cassette 25 is mounted to the lower portion of the device case 11 so that it can be attached or removed. A number of sheets of record paper 26 are contained in the paper feed cassette 25 in a laminated state. With the rotation of a pickup roller 27, the record paper 26 is fed out from the inside of the paper feed cassette 25 sheet by sheet and is sent between the photosensitive drum 12 and the transferring roller 16 along a paper guide 28 by two pairs of feeding rollers 29 and 30.

The transferring roller 16 is arranged to be brought into contact with the outer peripheral face of the photosensitive drum 12 over a record paper transfer path defined by the paper guide 28 and is rotated by a drive source, not illustrated. The transferring roller 16 is constituted by a shaft 16*a* made of a metal (for example, stainless steel) and a conductive foam body (preferably urethane foam) 16*b* attached at the surrounding of the shaft 16*a*. A predetermined bias voltage is applied to the transferring roller 16 from a high voltage generating unit 34 illustrated in FIG. 2 via the shaft 16*a*.

The record paper 26 sent between the photosensitive drum 12 and the transferring roller 16, is brought into close contact with the outer peripheral face of the photosensitive drum 12 by the transferring roller 16 (i.e., the paper 26 is nipped between the photosensitive drum 12 and the transferring roller 16). The rear side face of the record paper 26 is brought into contact with the transferring roller 16 to which voltage is applied. Then, the toner image on the photosensitive drum 12 is attracted toward the record paper 26 and is transferred onto the record paper 26 based on the potential difference between the photosensitive drum 12 and the transferring roller 16. After transferring the toner image, the record paper 26 is sent toward a fixing unit 31 by the rotation of the photosensitive drum 12 and the transferring roller 16.

The fixing unit 31 is arranged in the device case 11 on the exit side of the photosensitive drum 12 (left in the illustration) and is provided with a heating roller 31*a* and a pressing roller 31*b* for bringing the record paper into pressured conduction with the heating roller 31*a*. The heating roller 31*a* and the pressing roller 31*b* are opposed to each other over the record paper transferring path. Further, by feeding the record paper 26 between the heating roller 31*a* and the pressing roller 31*b* along another paper guide 32, a resin component in the toner is melted and is adhered to the record paper 26. As a result, the toner image is fixed onto the record paper 26 as a permanent image. Thereafter, the record paper 26 is discharged outside of the device case 11 by a pair of discharge rollers 33.

Meanwhile, after transferring the toner image, the outer peripheral face of the photosensitive drum 12 is charged at a positive potential by the operation of the transferring roller 16 and is moved to a position opposed to the charger 13 with the rotation of the photosensitive drum 12. Further, the outer peripheral face of the photosensitive drum 12 is uniformly charged again at approximately −750V by the charger 13. Also, more or less untransferred toner remains on the outer peripheral face of the photosensitive drum 12 after transfer. When the remaining toner is transferred to a position opposed to the charger 13 with the rotation of the photosensitive drum 12, the remaining toner is dispersed uniformly on the outer peripheral face of the photosensitive drum 12 by being stroked with the brush-like charger 13 and is charged at about −750V. The remaining dispersed toner does not adversely influence the later formation of the electrostatic latent image by the exposer 14. Further, the remaining dispersed toner is attached to the developing roller 22 based on the potential difference in respect of the developing roller 22 when it is transferred to a position opposed to the developing roller 22 of the developer unit 15 with the rotation of the photosensitive drum 12, and is returned to the toner case 20. In other words, the developer unit 15 also carries out a cleaning operation for recovering the remaining toner dispersed by the charger 13 in parallel with the developing operation. Accordingly, the outer peripheral face of the photosensitive drum 12 can be prevented from being contaminated by the remaining toner, and further, all the toner can be used in the developing operation without waste.

Figure 2:
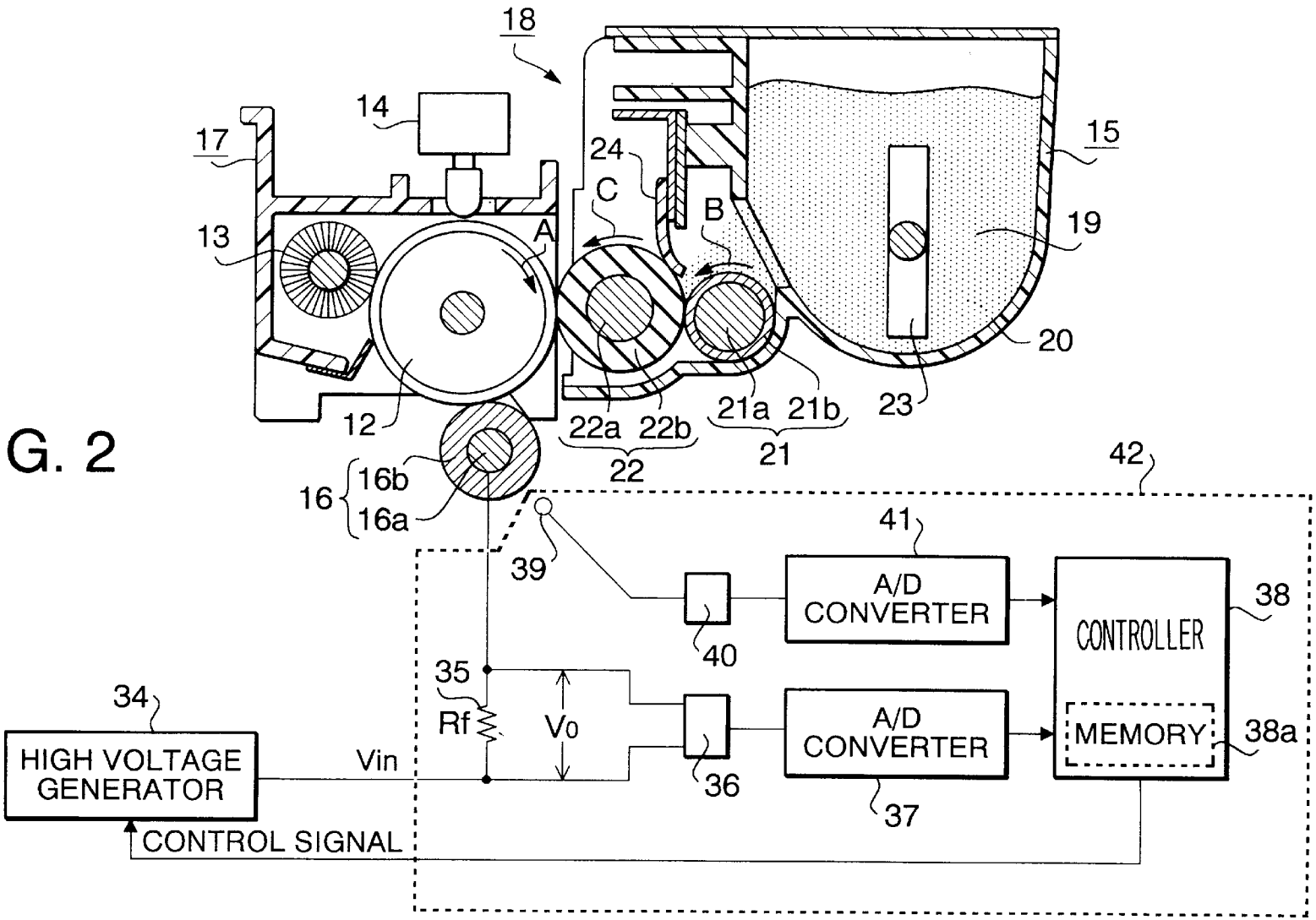
FIG. 2 is an enlarged sectional view of a process unit of the image recording device shown in FIG. 1 together with associated parts.

Referring now to FIG. 2, a description will be given of the constitution for applying the bias voltage to the transferring roller 16. The high voltage generating unit 34 is for applying high voltage of the bias voltage Vin to the transferring roller 16 and includes a power supply portion, a transforming portion for converting supply voltage from the power source supply portion to a predetermined voltage, a transformer for stepping up the voltage from the transforming portion, and the like. To constitute the transforming portion, for example, a DC (Direct Current)-DC converter is used. An adjusting means 42 is provided for adjusting the voltage Vin for application to the transferring roller 16 by controlling the high voltage generating unit 34 such that the toner image is transferred properly (in other words, such that the transferring roller 16 is set to a voltage optimum for transferring the toner image).

Explaining with respect to the adjusting means 42, a fixed resistor 35 having a predetermined resistance value Rf is arranged in series between the high voltage generating unit 34 and the transferring roller 16. Both ends of the resistor 35 are connected to a pair of input terminals on a voltage detector 36. The voltage detector 36 is constituted by a differential amplifier, resistors and the like, and outputs a voltage signal in accordance with a potential difference (voltage) Vo across both ends of the resistor 35 to an A/D convertor 37 based on the input voltage from the respective input terminals. The A/D convertor 37 converts the inputted voltage signal into a digital signal and outputs it to a controller 38 as a determining means. According to the embodiment, a first detecting means is constituted by the resistor 35, the voltage detector 36 and the controller 38.

A temperature sensor 39 that is a second detecting means, is arranged in the vicinity of the transferring roller 16 and outputs a detection signal in accordance with an environmental temperature surrounding the transferring roller 16 to an A/D converter 41 via an amplifier 40. The A/D convertor 41 converts the inputted detection signal into a digital signal and outputs it to the controller 38.

The controller 38 is for controlling the operation of the entire image recording device 10 and includes CPU (Central Processing Unit), ROM (Read Only Memory) and RAM (Random Access Memory). ROM and RAM are collectively illustrated as memory 38*a* in the drawing. The controller 38 determines an optimum voltage to be applied to the transferring roller 16 prior to starting the image recording operation and controls the high voltage generating unit 34 such that the determined optimum voltage is applied on the transferring roller 16 in the image recording operation. Specifically, prior to starting the image recording operation, the controller 38 causes the high voltage generating unit 34 to apply the predetermined bias voltage Vin to the transferring roller 16 by outputting a control signal to the high voltage generating unit 34. In this state, the controller 38 calculates the voltage Vo across both ends of the resistor 35 based on the voltage signal from the voltage detector 36 and also calculates a resistance value of the entire process unit 18 based on the voltage Vo.

Figure 3:
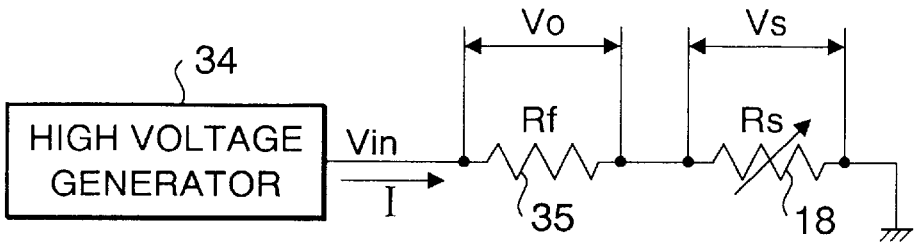
FIG. 3 is an equivalent circuit diagram including the process unit, a resistor and a high voltage generating unit.

Before starting the image recording operation, the record paper 26 is not present between the photosensitive drum 12 and the transferring roller 16. In this state, the transferring roller 16 is brought into direct contact with the photosensitive drum 12. Meanwhile, the charger 13 and the developing roller 22 are brought into direct contact with the photosensitive drum 12, and the supply roller 21 and the regulating blade 24 indirectly contact the photosensitive drum 12 via the developing roller 22. Accordingly, the above-described parts 12, 13, 16, 21, 22 and 24 in the process unit 18 can be regarded as one resistor body, and the resistor (that is, the process unit 18), the resistor 35 and the high voltage generating unit 34 can be represented in an equivalent circuit as illustrated in FIG. 3. Incidentally, the resistance value of the transferring roller 16 comprised of urethane foam or the like is changed by temperature and humidity or the like, and accordingly, the process unit 18 can be regarded as a variable resistor.

As illustrated in FIG. 3, when the resistance value of the process unit 18 is designated by notation Rs and the voltage across both ends of the process unit 18 is designated by notation Vs, the following equation (1) is established when the predetermined bias voltage Vin is outputted from the high voltage generating unit 34.

$$Vin=Vo+Vs \tag{1}$$

Equation (1) can be modified into the following Equation (2) and Equation (3). Incidentally, notation I designates current flowing in the equivalent circuit as illustrated in FIG. 3.

$$\begin{aligned} Vin &= Vo + Vs \\ &= Vo + IRs \end{aligned} \tag{2}$$

$$\begin{aligned} RS &= (Vin - Vo)/I \\ &= (Vin - Vo)Rf/Vo \\ &= (Vin/Vo - 1)Rf \end{aligned} \tag{3}$$

Accordingly, the controller 38 calculates the resistance value Rs of the process unit 18 based on Equation (3).

As mentioned above, the resistance value Rs of the entire process unit 18 can be calculated by calculating the voltage Vo across both ends of the resistor 35 when the predetermined bias voltage Vin is outputted from the high voltage generating unit 34.

Figure 4:
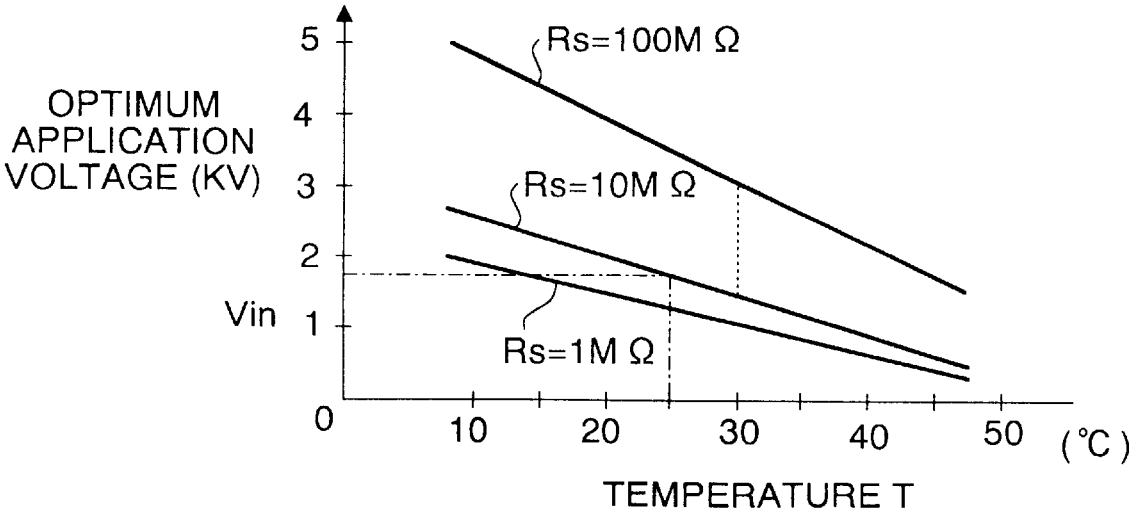
FIG. 4 shows a map stored in a memory of the image recording device shown in FIG. 1.

Further, prior to starting the image recording operation, the controller 38 detects the environmental temperature T surrounding the transferring roller 16 based on the detection signal from the temperature sensor 39. Further still, the controller 38 determines the optimum voltage Vin to be applied to the transferring roller 16 in accordance with a map shown in FIG. 4 based on the previously calculated resistance value Rs of the process unit 18 and the temperature T surrounding the transferring roller 16. The map of FIG. 4 is data (shown by straight lines) showing the relationship between the temperature T surrounding the transferring roller 16 and the optimum voltage Vin to be applied to the transferring roller 16 with the respective resistance values Rs of the process unit 18 being parameters (for example, at every increase of 10 megaohms (MΩ) in a range of 1 through 100 megaohms). The data in the map have been provided in advance by experimentation and stored in the memory 38*a* of the controller 38. For example, when the calculated resistance value Rs of the process unit 18 is 10 megaohms or in the vicinity thereof, the controller 38 refers the data in correspondence with 10 megaohms in the map of FIG. 4 and determines the optimum voltage Vin in correspondence with the detected temperature T. Incidentally, the map of FIG. 4 is only an example, and the relationship between the temperature and the optimum voltage, or the number of lines of data, or the like, in the respective data in the map can be changed appropriately in accordance with the kind of the image recording device employed.

Further, the controller 38 outputs the control signal in accordance with the optimum voltage Vin to the high voltage generating unit 34 such that the predetermined optimum voltage Vin is applied to the transferring roller 16 in the image recording operation. It should be noted that in the image recording operation, unlike conditions before the start of the recording operation (in other words, unlike conditions when measuring the resistance value Rs of the process unit 18), the record paper 26 is present between the photosensitive drum 12 and the transferring roller 16. That is, the measurement of the resistance value Rs of the process unit 18 is carried out under conditions different from that of the actual image recording operation. Accordingly, the map of FIG. 4 has been prepared in previous consideration of the condition in the actual image recording operation such that the voltage Vin applied to the transferring roller 16 is optimized in the actual image recording operation.

Next, a description will be given of the operation of the image recording device 10 constituted as described above.

Figure 5:
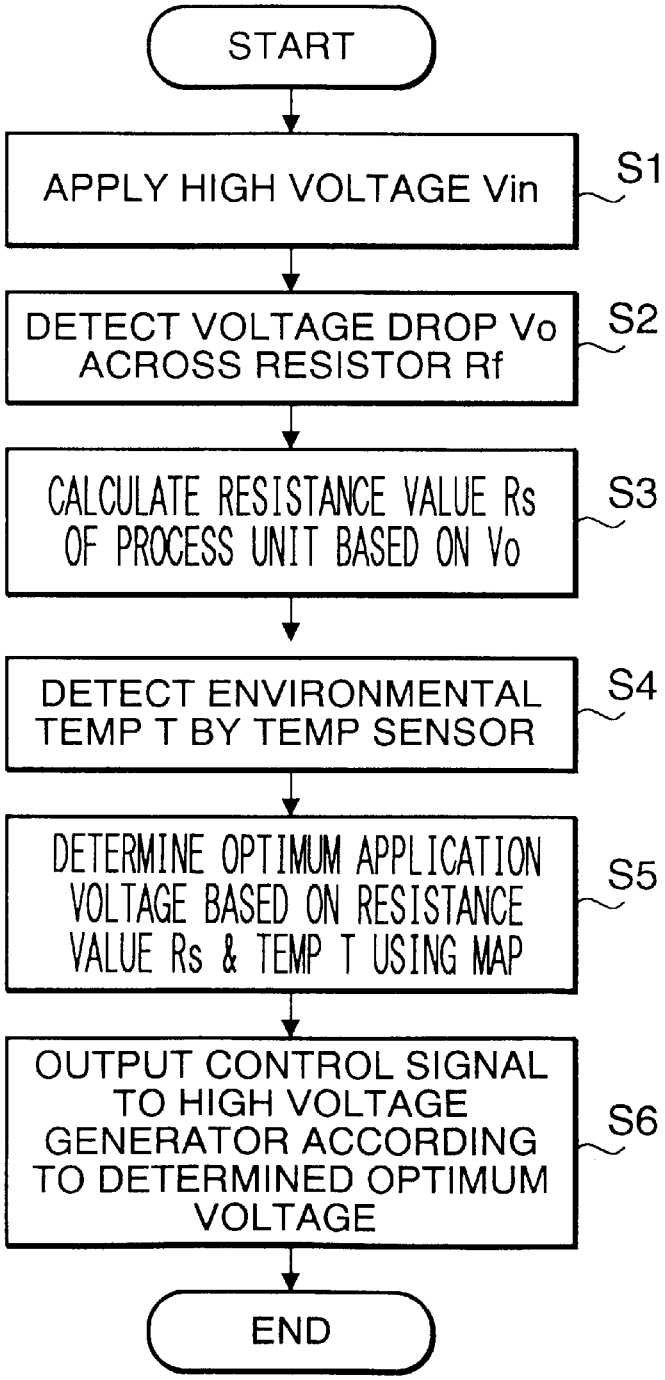
FIG. 5 is a flow chart showing operation before starting an image recording operation.

According to the image recording device 10 of this embodiment, prior to starting the image recording operation (in other words, operation of transferring a toner image), an operation illustrated in the flowchart of FIG. 5 is carried out under the control of the controller 38. That is, firstly, the predetermined high voltage Vin is applied from the high voltage generating unit 34 to the transferring roller 16 based on the control signal from the controller 38 (step S1). The magnitude of the voltage Vin is predetermined and known in order to calculate the resistance value Rs of the process unit 18. Next, the voltage Vo across both ends of the resistor 35 when the voltage Vin is applied is detected by the voltage detector 36 or the like (step S2), and the resistance value Rs of the entire process unit 18 is calculated in accordance with Equation (3) based on the detected voltage Vo (step S3). Successively, the environmental temperature T surrounding the transferring roller 16 is detected by the temperature sensor 39 (step S4).

Further, the optimum voltage Vin to be applied to the transferring roller 16 is determined in accordance with the map of FIG. 4 based on the previously calculated resistance value Rs and the temperature T (step S5). Next, the control signal, in accordance with the determined optimum voltage, Vin, is outputted to the high voltage generating unit 34 (step S6). As a result, the optimum voltage Vin is applied from the high voltage control unit 34 to the transferring roller 16 and the voltage of the transferring roller 16 is set to a value optimum for transferring the toner image. Further, the image forming operation is carried out in this condition and the toner image on the photosensitive drum 12 is firmly transferred onto the record paper 26 by the operation of the transferring roller 16.

Accordingly, the embodiment achieves the following effects.

(1) The voltage Vin to be applied to the transferring roller 16 is adjusted such that the voltage of the transferring roller 16 becomes a value optimum for transferring the toner image on the record paper 26. Specifically, prior to starting the image recording operation, at least the resistance value Rs of the entire process unit 18 including the transferring roller 16 and the environmental temperature surrounding the transferring roller 16 are detected. Further, the optimum voltage Vin to be applied to the transferring roller 16 is determined based on the detected resistance value Rs and the detected temperature T and the high voltage generating Unit 34 is controlled such that the determined optimum voltage Vin is applied to the transferring roller 16 in the image recording operation.

Therefore, even if the resistance value of the transferring roller 16 changes in accordance with environmental conditions such as humidity, temperature or the like, the voltage of the transferring roller 16 can always be set to a value that is optimum for transferring the toner image. Accordingly, the toner image on the photosensitive drum 12 can be effectively transferred onto the record paper 26 always under optimum conditions, and a uniform, high-quality image can be transferred onto the record paper 26.

(2) The voltage to be applied to the transferring roller 16 is determined based on the resistance value Rs of the entire process unit 18 as the inner condition and the environmental temperature T surrounding the transferring roller 16 as the outer condition. Therefore, the voltage to be applied to the transferring roller 16 is determined to an appropriate value based on the plurality of conditions.

The resistance value of the transferring roller 16 changes in accordance with changes in humidity, temperature or the like, and is particularly sensitive to the influence of temperature. Accordingly, the determination of the applied voltage to the transferring roller 16 in consideration of not only the resistance value Rs of the entire process unit 18 including the transferring roller 16 but the temperature condition at that time, is very effective in appropriately determining the voltage to be applied to the transferring roller 16 when compared with the case in which the voltage is uniquely determined in accordance with only the resistance value Rs of the entire process unit 18.

(3) In determining the voltage applied to the transferring roller 16, the resistance value Rs of not only the transferring roller 16 but other parts of the entire process unit 18, including the photosensitive drum 12 in contact with the transferring roller 16, and the like, is detected. In other words, a collective resistance value Rs of all parts related to the image forming operation is detected. Therefore, the voltage applied to the transferring roller 16 can be more properly determined in consideration of the resistance value Rs of all parts related to the image forming operation.

(4) The voltage applied to the transferring roller 16 can be easily and accurately determined in accordance with the previously prepared map as illustrated in FIG. 4.

The first embodiment can be modified as follow.

(i) Although the resistance value Rs of the entire process unit 18 is detected in the illustrated embodiment, a resistance value of only the transferring roller 16 may be detected. In order to be sufficiently effective, the present invention must at least detect a resistance value for the transferring roller 16.

(ii) The resistance value Rs of the entire process unit 18 may not necessarily be calculated based on the voltage Vo across both ends of the resistor 35. For example, the resistance value Rs may be calculated by omitting the resistor 35 and by detecting a current flowing in the process unit 18 when the predetermined high voltage Vin is applied.

(iii) The voltage applied to the transferring roller 16 may be determined by providing a humidity sensor surrounding the transferring roller 16 in addition to the temperature sensor 39 and considering the detected humidity as part of the outer condition.

(iv) The temperature sensor 39 may be provided at a position distant from the transferring roller 16. For example, the temperature sensor 39 may be provided outside of the image recording device 10 and the environmental temperature surrounding the recording device 10 may be detected by the temperature sensor 39. In this case, although a temperature at a location that is not influenced by heat generated by various parts in the recording device 10 can be detected, the various data in the map of FIG. 4 need to be changed from those in the case where the temperature sensor 39 is provided in the vicinity of the transferring roller 16.

(v) Although the operation shown by the flow chart of FIG. 5 may be carried out only before starting one recording operation, the operation may be carried out every time before starting the recording operation for each sheet of the record paper 26. In this way, the voltage applied to the transferring roller 16 can be adjusted more finely.

Second Embodiment

Next, a description will be given of a second embodiment of the present invention in reference to FIG. 6 through FIG. 8. Like reference numerals are allotted to like elements and parts and description of these parts are omitted.

Figure 6:
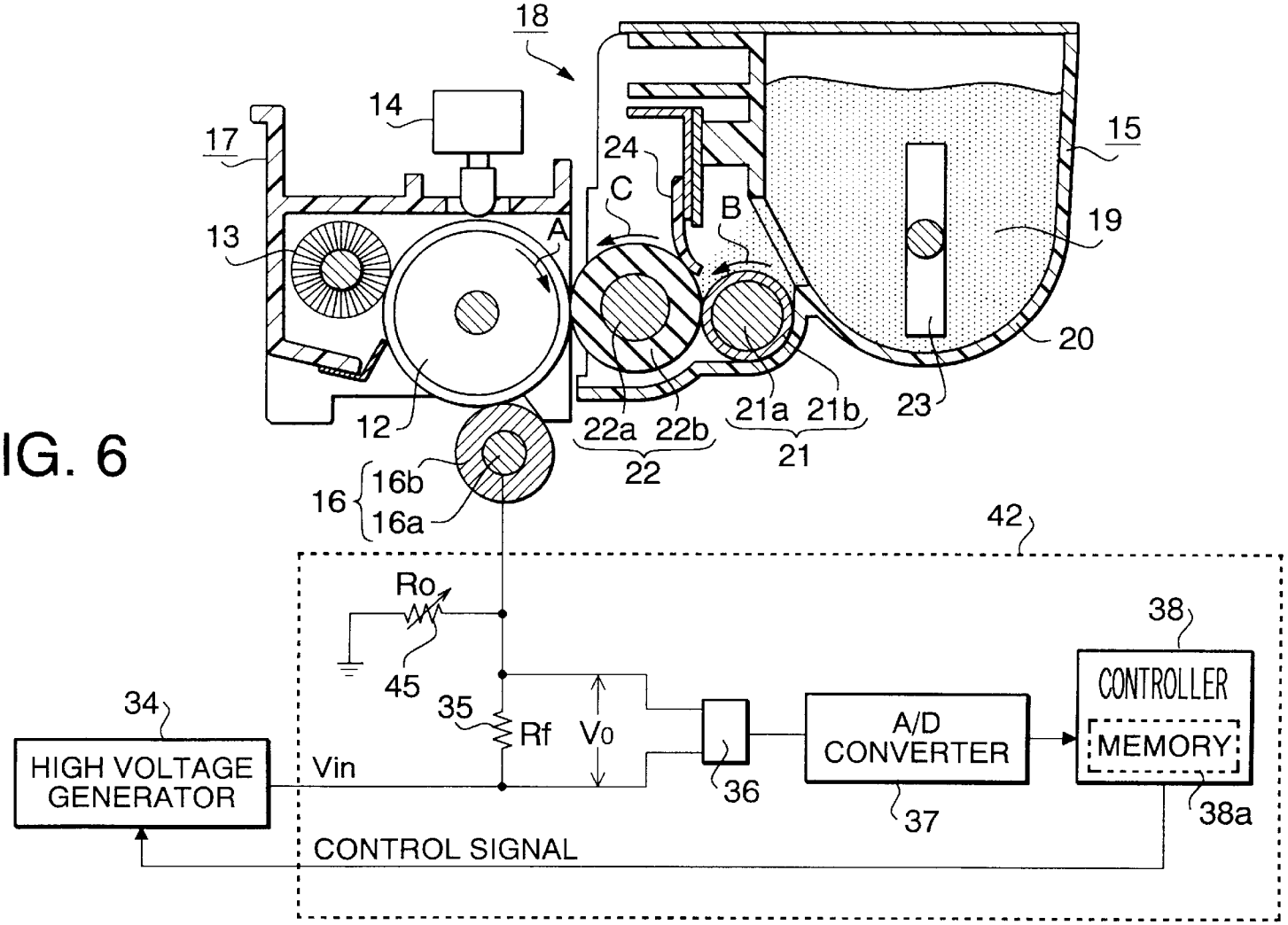
FIG. 6 is an enlarged sectional view of the process unit of an image recording device according to a second embodiment of the present invention together with its associated parts.

Referring to FIG. 6, the constitution of the adjusting means 42' for adjusting the voltage applied to the transferring roller 16 in the second embodiment is different from that in the first embodiment. Namely, according to the second embodiment, the temperature sensor 39 and the associated amplifier 40 and A/D converter 41 are not provided. Instead, a grounded variable resistor 45 is connected in parallel with the process unit 18 as a correcting means for correcting the environmental characteristic of the resistance value of the process unit 18. The variable resistor 45 may be arranged in the vicinity of the transferring roller 16 or may be arranged at a location remote from the transferring roller 16.

Figure 7:
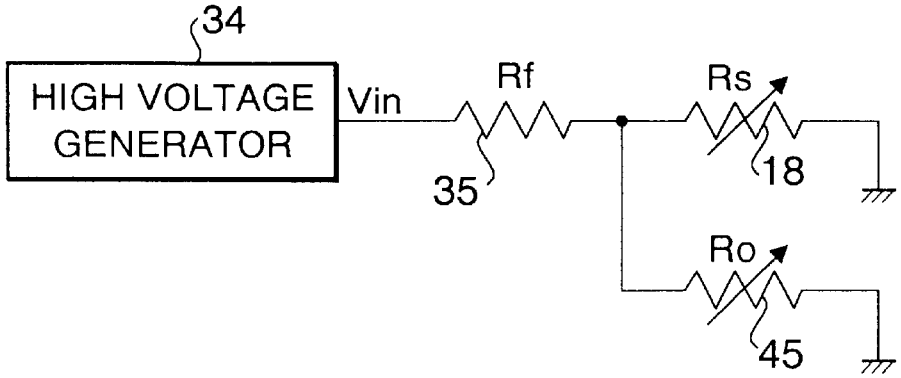
FIG. 7 is an equivalent circuit diagram including a variable resistor, a resistor and a process unit of the image recording device shown in FIG. 6.
Figure 8:
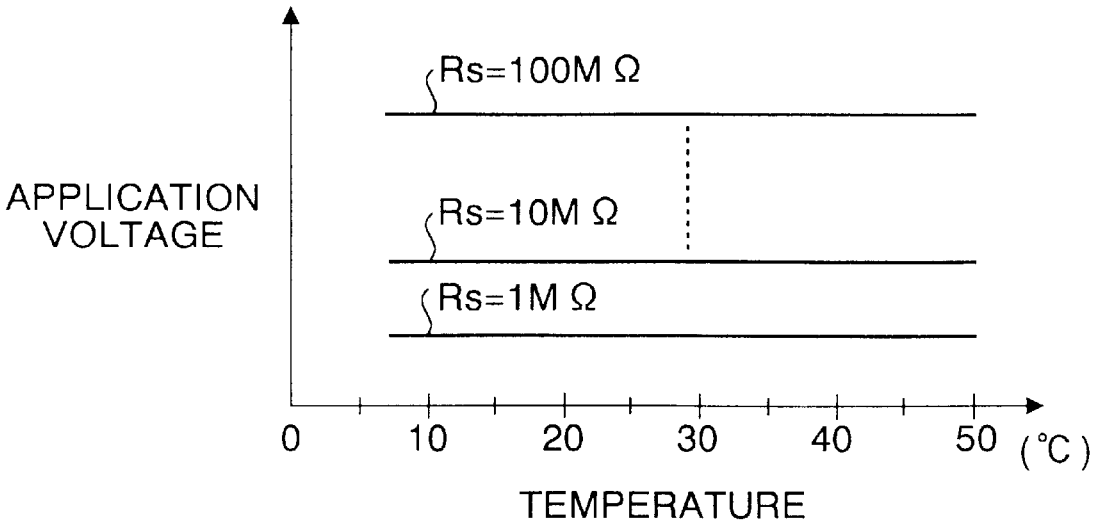
FIG. 8 illustrates the relationship between temperature and voltage applied to the transferring roller.

FIG. 7 illustrates the relationship of electrical connections among the variable resistor 45, the resistor 35 and the process unit 18 in an equivalent circuit. The variable resistor 45 is provided with a characteristic reverse to the characteristic of changing the resistance value Rs of the entire process unit 18 in respect of a change in temperature. As shown by the map in FIG. 4, the voltage Vin applied to the transferring roller 16 is lowered with an increase in the temperature T because the resistance value Rs of the entire process unit 18 is lowered with the increase in the temperature T. By contrast, the variable resistor 45 is provided with a positive characteristic where the resistance value Ro is increased with an increase in the temperature. Although the variable resistor 45 may be constituted by, for example, a single element of a temperature sensitive resistor or the like having the positive characteristic, or may include a means for changing the resistance value in accordance with the change in the temperature, a variable resistor having the following characteristic is preferable.

In short, a synthesized resistance Rt of the variable resistor 45, the resistor 35 and the process unit 18 can be represented by the following equation (4).

$$Rt=Rf+RoRs/(Ro+Rs) \tag{4}$$

Here, when Rt is determined to be a constant value ($\alpha$), the resistance value Ro of the variable resistor 45 can be represented by the following equation (5).

$$Ro=Rs(\alpha-Rf)/((Rs+Rf)-\alpha) \tag{5}$$

In short, a variable resistor 45 having the characteristic of the resistance value Ro established in equation (5) is preferable.

If the synthesized resistance value Rt of the variable resistor 45, the resistor 35 and the process unit 18 always stays constant regardless of a change in temperature, the load applied to the high voltage generating unit 34 always stays constant regardless of the change in temperature. As a result, even when the voltage outputted from the high voltage generating unit 34 is not changed in accordance with the change in temperature, the voltage applied to the transferring roller 16 can be kept constant.

Prior to starting the image recording operation, similar to the first embodiment, the voltage Vo across both ends of the resistor 35 is detected when the predetermined high voltage Vin is applied to the transferring roller 16. Further, the resistance value Rs of the entire process unit 18 is calculated based on the detected voltage Vo or the like. Then, the voltage Vin to be applied to the transferring roller 16 is uniquely determined based on the calculated resistance value Rs. Incidentally, although not particularly illustrated, data that set the relationship between the resistance value Rs of the entire process unit 18 and the voltage Vin applied to the transferring roller 16 are prerecorded in the memory 38*a* of the controller 38. Further, the controller 38 determines the voltage Vin that is applied in accordance with the resistance value Rs based on the data in the memory 38*a*. Incidentally, unlike the map shown in FIG. 4, the data do not define the relationship between the temperature and the applied voltage but simply establish the relationship between the resistance value and supplied voltage. In the image recording operation, the high voltage generating unit 34 is controlled such that the determined voltage Vin is applied to the transferring roller 16.

The variable resistor 45 that has a characteristic reverse to the characteristic of changing the resistance value Rs of the entire process unit 18 in respect of the change in temperature, is provided, and accordingly, the synthesized resistance Rt of the variable resistor 45, the resistor 35 and the process unit 18 always remains constant regardless of the change in temperature. Accordingly, even when, for example, as shown in FIG. 8, the voltage outputted from the high voltage generating unit 34 is not changed in accordance with the change in temperature but is determined uniquely based on the detected resistance value Rs of the entire process unit 18, the voltage applied to the transferring roller 16 is always set to a constant value that is optimum for transferring the toner image. Therefore, similar to the first embodiment, the toner image on the photosensitive drum 12 can effectively be transferred onto the record paper 26 under optimum conditions, and a uniform, high-quality image can be transferred onto the record paper 26.

The second embodiment may be modified as follows.

(1) Although the resistance value Rs of the entire process unit 18 is detected, a resistance value of only the transferring roller 16 may be detected. Further, the variable resistor 45 having a temperature-resistance characteristic reverse to the temperature-resistance characteristic of the resistance of the transferring roller 16 may be used.

(2) The variable resistor 45 may not necessarily be provided with a temperature-resistance characteristic totally reverse to the characteristic of the resistance value Rs of the entire process unit 18, and more or less deviation is allowable. If the deviation of the voltage applied to the transferring roller 16 from the optimum value is about between 500V and 600V, the quality of the transferred image is not adversely effected. If a variable resistor 45 having such a characteristic can be realized as a single element, its composition can be significantly simplified.

(3) The second embodiment may adopt any composition so far as the composition is such that the synthesized resistance value Rt of the variable resistor 45, the resistor 35 and the process unit 18 always remains constant regardless of the change in temperature. For example, similar to the first embodiment, a temperature sensor may be provided, and the resistance value of the variable resistor 45 may be regulated by the controller 38 based on the temperature detected by the temperature sensor. In this case, it is preferable to prerecord data setting a relationship between temperature and the resistance value in the memory 38*a*.

(4) The resistance value Rs of the entire process unit 18 may not necessarily be calculated based on the voltage Vo across both ends of the resistor 35. For example, the resistance value Rs may be calculated by omitting the resistor 35 and by detecting a current flowing in the process unit 18 when the predetermined high voltage Vin is applied.

Incidentally, the image recording devices according to the first and the second embodiments can be preferably adopted in recording units of various printers, copiers and facsimile devices.

What is claimed is:

1. An image recording device comprising:

a paper feed device for feeding paper;

a photosensitive body;

means for forming a toner image on the photosensitive body;

a transferring roller arranged opposite the photosensitive body such that the paper fed from the paper feed device is nipped between the photosensitive body and the transferring roller;

a voltage generator for generating a voltage, at least a portion of which is to be applied to the transferring roller;

adjusting means for adjusting the voltage generated by the voltage generator such that transfer of the toner image onto the paper is properly carried out, the adjusting means including first detecting means for detecting a collective resistance of the transferring roller and the photosensitive body and determining means for determining the voltage generated by the voltage generator based on a detection result of the first detecting means.

2. The image recording device according to claim 1 wherein said adjusting means further includes second detecting means for detecting an environmental condition prior to the transfer of the toner image; wherein the determining means for determines the voltage generated by the voltage generator based on detection results of the first and second detecting means.

3. The image recording device according to claim 2 further including resistance detection means and a temperature sensor, and wherein the first detecting means detects at least the resistance value of the transferring roller using the resistance detection means and the second detecting means detects an environmental temperature as the environmental condition using the temperature sensor.

4. An image recording device comprising:

a paper feed device for feeding paper;

a photosensitive body;

means for forming a toner image on the photosensitive body;

a transferring roller arranged opposite the photosensitive body such that the paper fed from the paper feed device is nipped between the photosensitive body and the transferring roller;

a voltage generator for generating a voltage, at least a portion of which is to be applied to the transferring roller;

adjusting means for adjusting the voltage generated by the voltage generator such that transfer of the toner image onto the paper is properly carried out, wherein the adjusting means includes correcting means responsive to an environmental characteristic of a resistance value of a process unit forming the toner image, the process unit including at least the photosensitive body and transferring roller.

5. The image recording device according to claim 4, wherein the correcting means is a variable resistor which varies in an opposite manner to a variation of the resistance value of the process unit forming the toner image.

6. The image recording device according to claim 4, wherein the adjusting means includes a variable resistor which has a temperature-resistance characteristic reverse to a temperature-resistance characteristic of the process unit.

7. The image recording device according to claim 4, wherein the variable resistor is connected in parallel to the process unit.

8. The image recording device according to claim 6, wherein the variable resistor is connected in parallel to the process unit.

9. The image recording device according to claim 1 further including a characteristic map which provides relationship between temperature and optimum voltage and wherein the adjusting means adjusts the voltage using the characteristic map.

10. The image recording device according to claim 3 further including a humidity sensor and wherein the second detecting means further detects the environmental humidity as the environmental condition using the humidity sensor.

11. The image recording device according to claim 3, where the temperature sensor is located near the transferring roller.

12. The image recording device according to claim 3, where the temperature sensor is located outside the image recording device.

13. A method for use with an image recording device including a paper feed device for feeding paper; a photosensitive body; means for forming a toner image on the photosensitive body; a transferring roller arranged mutually opposed to the photosensitive body such that the paper fed from the paper feed device is nipped between the photosensitive body and the transferring roller; a voltage generator for generating an output voltage, at least a portion of which is to be applied to the transferring roller, the toner image on the photosensitive drum being transferred to the paper upon application of the voltage to the transferring roller, the method comprising the steps of:

A) detecting a collective resistance of the transferring roller and the photosensitive body of the image recording device prior to the transfer of the toner image;

B) detecting an environmental condition of the image recording device prior to the transfer of the toner image;

C) determining the output voltage of the voltage generator based on detection results of the steps A and B.

14. The method of claim 13, wherein the step A includes a substep of at least detecting the resistance value of the transferring roller.

15. The method of claim 13, wherein the step B includes a substep of at least detecting an environmental temperature.

16. The method of claim 13 further including the step of preparing a characteristic map which establishes the relationship between temperature and optimum voltage and wherein the step C is carried out by referring to the characteristic map.

17. The method of claim 13, wherein the step B further includes detecting an environmental humidity.

* * * * *